US010103419B2

(12) United States Patent
Tsukahara et al.

(10) Patent No.: US 10,103,419 B2
(45) Date of Patent: Oct. 16, 2018

(54) WAVEGUIDE COMPRISED OF A SOLID DIELECTRIC WHICH IS SURROUNDED BY FIRST AND SECOND POWER SUPPLYING LINES AND FIRST AND SECOND SLIDABLE CONDUCTORS

(71) Applicant: MOLEX INCORPORATED

(72) Inventors: Takeshi Tsukahara, Yamato (JP); Shigeyuki Hoshikawa, Yamato (JP); Mio Tanaka, Yamato (JP)

(73) Assignee: Molex, LLC, Lisle, IL (US)

( * ) Notice: Subject to any disclaimer, the term of this patent is extended or adjusted under 35 U.S.C. 154(b) by 4 days.

(21) Appl. No.: 15/313,615

(22) PCT Filed: May 26, 2015

(86) PCT No.: PCT/JP2015/065074

§ 371 (c)(1),
(2) Date: Nov. 23, 2016

(87) PCT Pub. No.: WO2015/186567

PCT Pub. Date: Dec. 10, 2015

(65) Prior Publication Data

US 2017/0201000 A1 Jul. 13, 2017

(30) Foreign Application Priority Data

Jun. 2, 2014 (JP) ..... 2014-113901

(51) Int. Cl.
*H01P 3/12* (2006.01)
*H01P 3/16* (2006.01)

(52) U.S. Cl.
CPC ..... *H01P 3/122* (2013.01); *H01P 3/121* (2013.01); *H01P 3/16* (2013.01)

(58) Field of Classification Search
CPC ..... H01P 3/12; H01P 3/121; H01P 3/122
(Continued)

(56) References Cited

U.S. PATENT DOCUMENTS 5,986,527 A 11/1999 Ishikawa et al.
6,501,350 B2 * 12/2002 Lester ..... H01Q 13/206 333/237

(Continued)

FOREIGN PATENT DOCUMENTS

EP 0 343 771 A1 11/1989
JP S57-19883 B2 4/1982
JP 2005-175874 A 6/2005

*Primary Examiner* — Benny Lee
(74) *Attorney, Agent, or Firm* — James A. O'Malley

(57) ABSTRACT

The present disclosure enhances flexibility, enables the transmission of power, and improves reliability using a simple, low-cost, easy-to-manufacture configuration by disposing a pair of power supplying lines on the outside in the longitudinal direction of the rectangular cross-section of a dielectric. Here, a waveguide is provided with a solid dielectric, a pair of power supplying lines and an external conductor surrounding the dielectric. The solid dielectric has a rectangular cross-section. The pair of power supplying lines are disposed on the outside in the longitudinal direction of the cross-section of the dielectric. The outer surface of the dielectric is slidably in close contact with the inner surface of the external conductor.

12 Claims, 6 Drawing Sheets

(58) Field of Classification Search
USPC ..... 333/239, 248
See application file for complete search history.

(56) References Cited

U.S. PATENT DOCUMENTS

2013/0307645 A1* 11/2013 Mita et al. ..... H01P 3/12
333/248
2016/0056860 A1* 2/2016 Okada ..... H04B 3/52
375/257

* cited by examiner

WAVEGUIDE COMPRISED OF A SOLID DIELECTRIC WHICH IS SURROUNDED BY FIRST AND SECOND POWER SUPPLYING LINES AND FIRST AND SECOND SLIDABLE CONDUCTORS

RELATED APPLICATIONS

This application is a national stage of International Application No. PCT/JP2015/065074, filed May 26, 2015, which claims priority to Japanese Application No. 2014-113901, filed Jun. 2, 2014, both of which are incorporated herein by reference in their entirety.

TECHNICAL FIELD

The present disclosure relates to a waveguide.

BACKGROUND ART

Waveguides have been proposed in which electromagnetic waves of a higher frequency band such as microwaves and millimeter waves are transmitted and power can be transmitted as well by surrounding a conductive wire with a dielectric (see, for example, Patent Document 1).

FIG. 6 is a cross-sectional view of a waveguide of the prior art.

In this drawing, 891 is a solid conductor serving as the conductive wire disposed in the center, and 851, 852, and 853 are dielectrics having different dielectric constants. Here, 892 is another conductor. Electromagnetic waves can be transmitted while confined to the dielectric 852 by ensuring that the dielectric constant of dielectric 852 is the highest dielectric constant. Power can also be transmitted by applying direct current voltage between the solid conductor 891 and the other conductor 892.

Patent Document 1: JP S57-019883 A

SUMMARY

However, in waveguides of the prior art, the cross-sectional profile cannot take the form of a rectangle. Therefore, waveguides cannot be provided which have a general rectangular cross-sectional profile as waveguides for microwaves and millimeter waves.

The present disclosure provides a highly flexible and more reliable waveguide which is able to transmit power using a simple, low-cost, easy-to-manufacture configuration by disposing a pair of power supplying lines on the outside in the longitudinal direction of the rectangular cross-section of a dielectric.

In order to realize the foregoing, the present disclosure is a waveguide comprising: a solid dielectric having a rectangular cross-section, a pair of power supplying lines disposed on the outside in the longitudinal direction of the cross-section of the dielectric, and an external conductor surrounding the dielectric; the outer surface of the dielectric being slidably in close contact with the inner surface of the external conductor.

In a waveguide according to another aspect of the present disclosure, the external conductor includes a pair of planar external conductor members disposed on the outside in the short-axis direction of the cross-section of the dielectric.

In a waveguide according to another aspect of the present disclosure, the dielectric and the power supplying lines are disposed in a row in the longitudinal direction of the cross-section of the dielectric, and the external conductor members are laminated on both sides in the direction of arrangement of the dielectric and the power supplying lines.

In a waveguide according to another aspect of the present disclosure, the external conductor members are bonded to both surfaces of the power supplying lines.

In a waveguide according to another aspect of the present disclosure, the external conductor includes an adjustment member disposed between the dielectric and the power supplying lines.

In the present disclosure, a pair of power supplying lines are disposed on the outside in the longitudinal direction of the rectangular cross-section of a dielectric. In this way, the waveguide is both highly flexible and able to transmit power. The waveguide is also easy to manufacture at lower cost, has a simpler configuration, and is more reliable.

DETAILED DESCRIPTION OF THE PREFERRED EMBODIMENTS

The following is a detailed explanation of an embodiment of the present disclosure with reference to the drawings.

Figure 1:
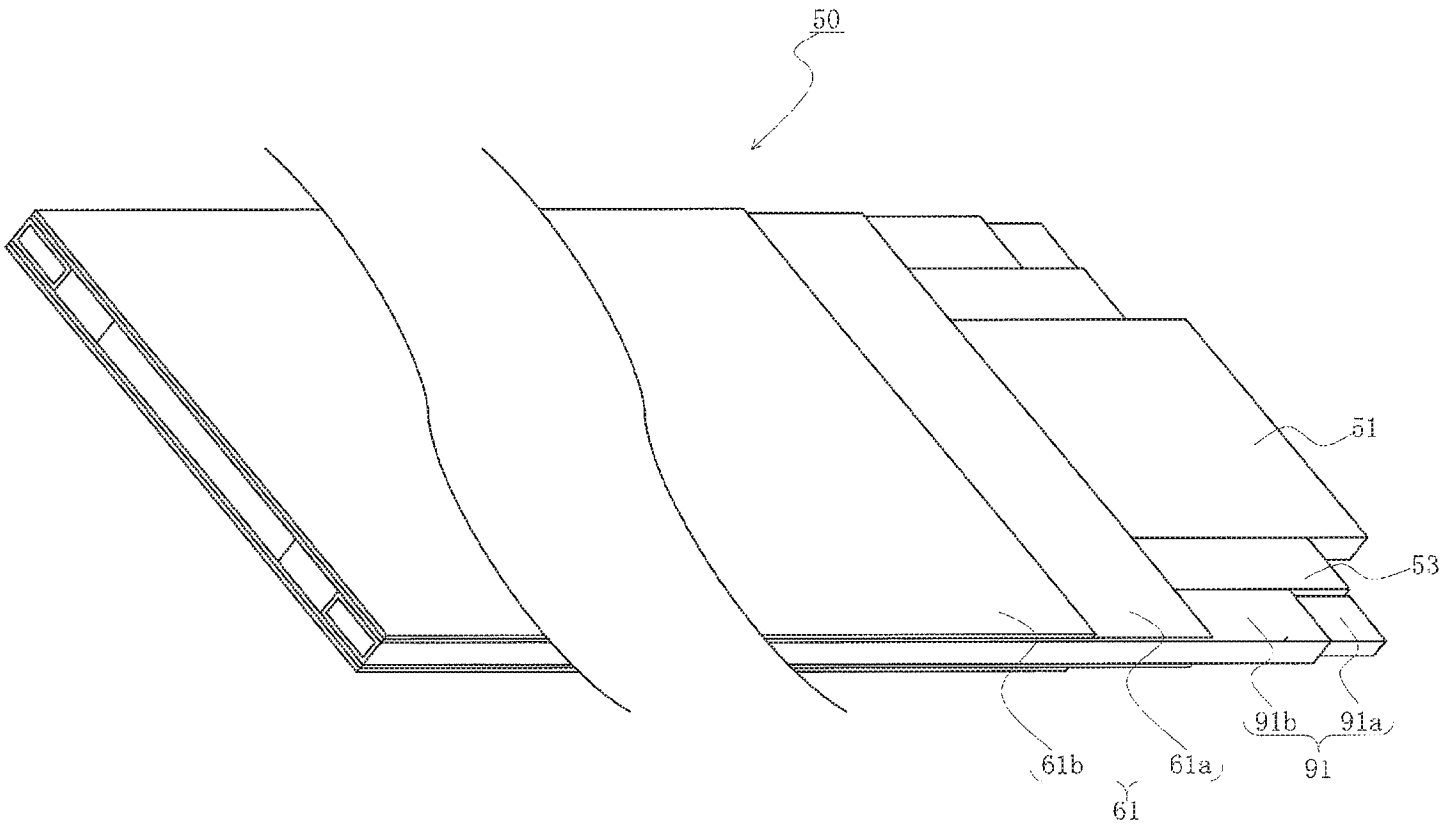
FIG. 1 is a first perspective view of the waveguide in an embodiment of the present disclosure.
Figure 2:
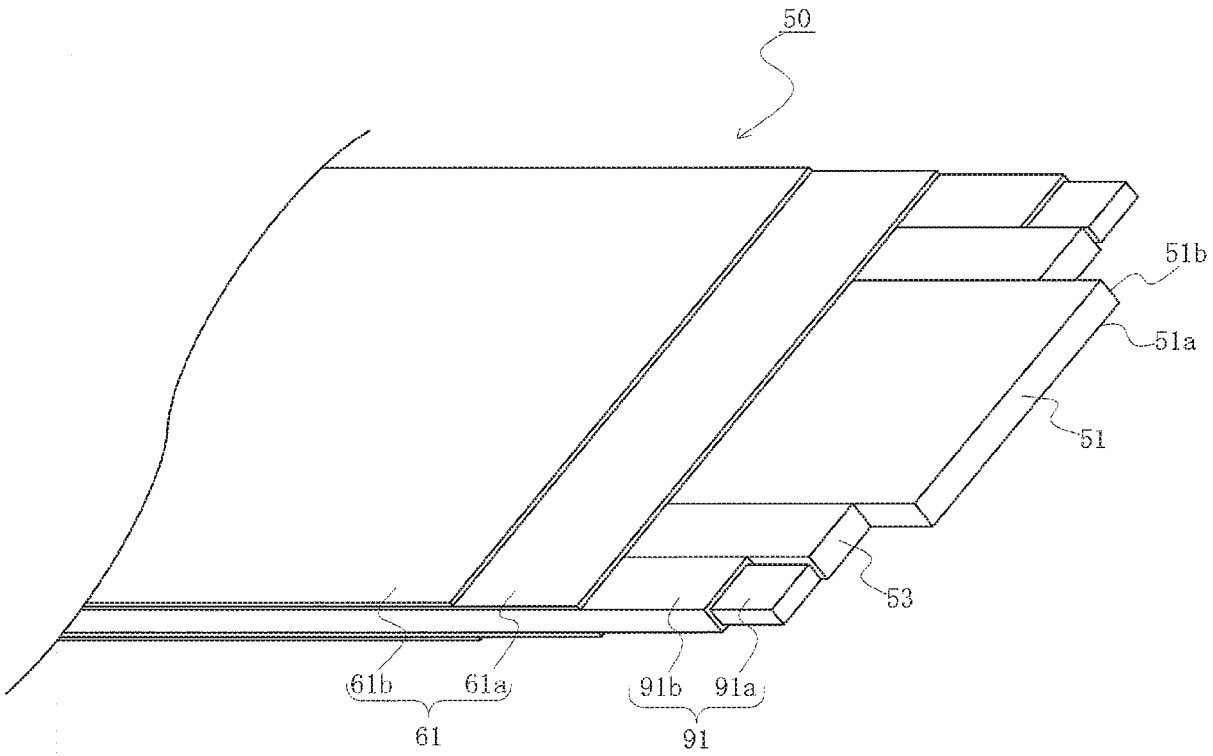
FIG. 2 is a second perspective view of the waveguide in the embodiment of the present disclosure.
Figure 3:
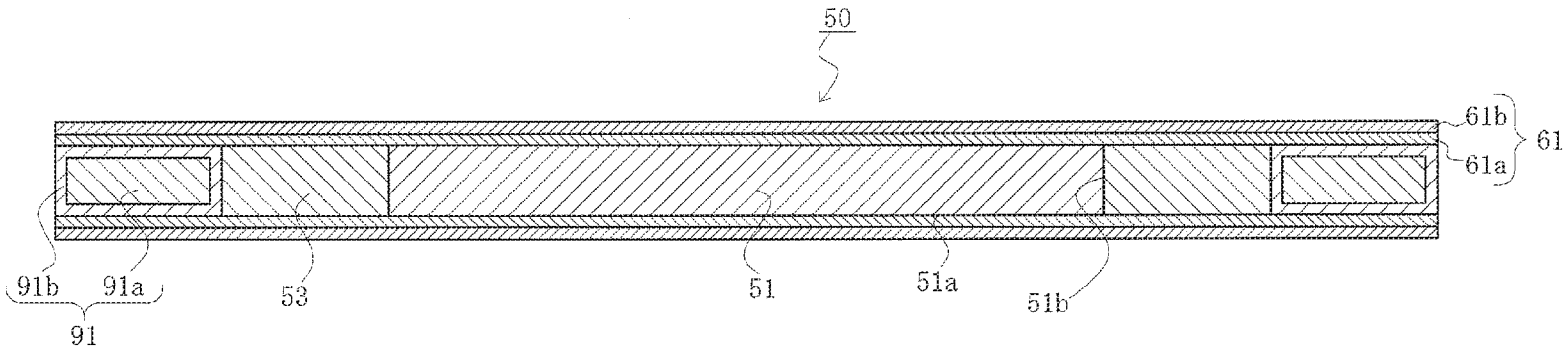
FIG. 3 is a cross-sectional view of the waveguide in the embodiment of the present disclosure.

FIG. 1 is a first perspective view of the waveguide in an embodiment of the present disclosure, FIG. 2 is a second perspective view of the waveguide in the embodiment of the present disclosure, and FIG. 3 is a cross-sectional view of the waveguide in the embodiment of the present disclosure.

In the drawings, 50 denotes the waveguide in the present embodiment which functions as a transmission route for transmitting electromagnetic waves of a higher frequency band such as microwaves and millimeter waves. The waveguide 50 is usually an elongated member. In the example shown in FIG. 1, the middle of the waveguide is omitted and only the ends are shown for convenience of illustration. In order to show the internal structure, the configurational members positioned on the outside are gradually peeled away on one end. The other end is simply cut. FIG. 2 shows one end in FIG. 1 from a different angle. The other end in FIG. 1 is not depicted. The waveguide 50 is a flat, band-like elongated member whose dimension in the width direction (the left-right direction in FIG. 3) is, for example, 5 mm and whose dimension in the thickness direction (the up-down direction in FIG. 3) is, for example, 0.5 mm. These dimensions can be changed.

In the present embodiment, the expressions indicating direction, such as upper, lower, left, right, front and rear, which are used to explain the configuration and operation of the waveguide 50 and the other members, are relative and not absolute. They depend on the orientation of the waveguide 50 and the other members shown in the drawings.

When the orientation of the waveguide 50 and the other members changes, the interpretation changes in response to the change in orientation.

The waveguide 50 comprises: a solid dielectric 51 having a flat, rectangular cross-section; a pair of adjustment members 53 having a rectangular cross-section arranged on both sides of the dielectric 51 relative to the width direction of the waveguide 50; a pair of power supplying members 91 or power supplying lines disposed on the outside of each adjustment member 53 in the width direction of the waveguide 50; and a pair of planar external conductor members 61 disposed on both ends of the dielectric 51, adjustment members 53, and power supplying members 91 relative to the thickness direction of the waveguide 50. The adjustment members 53, power supplying members 91, and the external conductor members 61 function as external conductors surrounding the dielectric 51. Note that the dimensions of the dielectric 51, the adjustment members 53, and the power supplying members 91 are the same in the thickness direction of the waveguide 50. In other words, they have the same thickness. The dielectric 51, the adjustment members 53, the power supplying members 91, and the external conductor members 61 are slender rod-like, wire-like, or band-like elongated members.

The dielectric 51 is made of a flexible dielectric material such as a synthetic resin. Examples include fluororesins such as polytetrafluoroethylene, cycloolefin polymer (COP) resins, cyclic olefin copolymer (COC) resins, polypropylene (PP) resins, and polyethylene (PE) resins. The dielectric 51 is a solid rod-shaped or wire-shaped member continuously manufactured using an extrusion molding method in which a molten dielectric material is extruded from the opening in a die with a predetermined shape to impart a predetermined cross-sectional shape, and then allowed to solidify. As shown in FIG. 3, the cross-sectional shape of the dielectric 51 is rectangular with a pair of long sides 51*a* opposing each other and a pair of short sides 51*b* opposing each other.

The adjustment members 53 are made of a conductive material with good conductivity such as a metal. Examples include copper, gold, silver, aluminum, and alloys thereof. The adjustment members 53 may also be made of a dielectric material covered with a conductive material with good conductivity such as a metal. In other words, the adjustment members 53 may be members in which at least three of the four sides of the rectangular cross-section, that is, the sides facing the dielectric 51 and the external conductor members 61, are made of a conductive material with good conductivity such as a metal. The dimensions of the adjustment members 53 in the width direction of the waveguide 50 can be adjusted so that the dimension of the long sides 51*a* (FIGS. 2 and 3) of the dielectric 51 is suitable for transmission of electromagnetic waves at a given distance between the pair of power supplying members 91, or so that the distance between the pair of power supplying members 91 is suitable for connection to an electric connector (not shown) at a given dimension for the long sides 51*a* of the dielectric 51. The adjustment members 53 can also be omitted.

The power supplying members 91 are a pair of members disposed on the outside in the longitudinal direction of the cross-section of the dielectric 51. Each power supplying member 91 is composed of a core metal portion 91*a* made of a conductive material with good conductivity such as a metal, for example, copper, gold, silver, aluminum, or alloys thereof, and a covering portion 91*b* covering the core metal portion 91*a* made of a dielectric material with good adhesiveness and flexibility, for example, a polyester such as polyethylene terephthalate (PET).

The external conductor members 61 are a pair of members disposed on the outside in the short-axis direction of the cross-section of the dielectric 51. Each external conductor member 61 is composed of a film-like or foil-like conductive film portion 61*a* made of a conductive material with good conductivity such as a metal, for example, copper, gold, silver, aluminum, or alloys thereof, and a covering portion 61*b* covering one surface of the conductive film portion 61*a* and which is a film-like or foil-like member made of a polyester such as polyethylene terephthalate. The external conductor members 61 may also be a composite film obtained by laminating polyester film such as polyethylene terephthalate film on metal foil such as copper foil.

In the present embodiment, the covering portion 91*b* of the power supplying members 91 is bonded to the conductive film portion 61*a* of the external conductor members 61 using their natural adhesiveness. In other words, the pair of power supplying members 91 are bonded to the pair of external conductor members 61 positioned vertically.

However, the dielectric 51 is not bonded to any of the other adjustment members 53, the external conductor members 61 and the power supplying members 91, but is surrounded by the adjustment members 53, the external conductor members 61 and the power supplying members 91. In other words, the pair of long sides 51*a* of the dielectric 51 can be displaced in the axial direction of the waveguide 50 (the left-right direction in FIG. 1) relative to the conductive film portion 61*a* of the opposing external conductor members 61, and the pair of short sides 51*b* (FIGS. 2 and 3) of the dielectric 51 can be displaced in the axial direction of the waveguide 50 relative to the opposing adjustment members 53. In this way, the dielectric 51, the external conductor members 61, and the adjustment members 53 do not become restrained by each other and break even when external force is imparted that bends the waveguide 50 in the thickness direction.

If the dielectric 51, the external conductor members 61, and the adjustment members 53 were to be restrained by each other via bonding, external force imparted so as to bend the waveguide 50 in the thickness direction would cause cracks to develop in the external conductor members 61 due to the different materials constituting the dielectric 51, the external conductor members 61, and the adjustment members 53 have different bending characteristics. These cracks would cause significant electromagnetic wave transmission loss and electromagnetic waves would not be transmitted stably. Because the dielectric 51 has a rectangular cross-sectional profile and the direction of the electric field of the transmitted electromagnetic waves is parallel to the short sides 51*b* (in the thickness direction of the waveguide 50), cracks occurring in the external conductor members 61 positioned on the outer surfaces of the vertical long sides 51*a* would cause the electric field to become unstable and cause transmission loss to increase.

Therefore, the dielectric 51 in the waveguide 50 of the present embodiment is not bonded to the external conductor members 61 and the adjustment members 53, and the dielectric 51, the external conductor member 61, and the adjustment member 53 are not restrained by each other. When the waveguide 50 is bent in the thickness direction, the external conductor members 61 and the adjustment members 53 can slide over the outer surface of the dielectric 51 while remaining in close contact, and the dielectric 51, the external conductor member 61, and the adjustment members 53 do not break. As a result, electromagnetic waves can be stably transmitted by the waveguide 50.

The following is an explanation of the method for manufacturing this waveguide 50.

Figure 4:
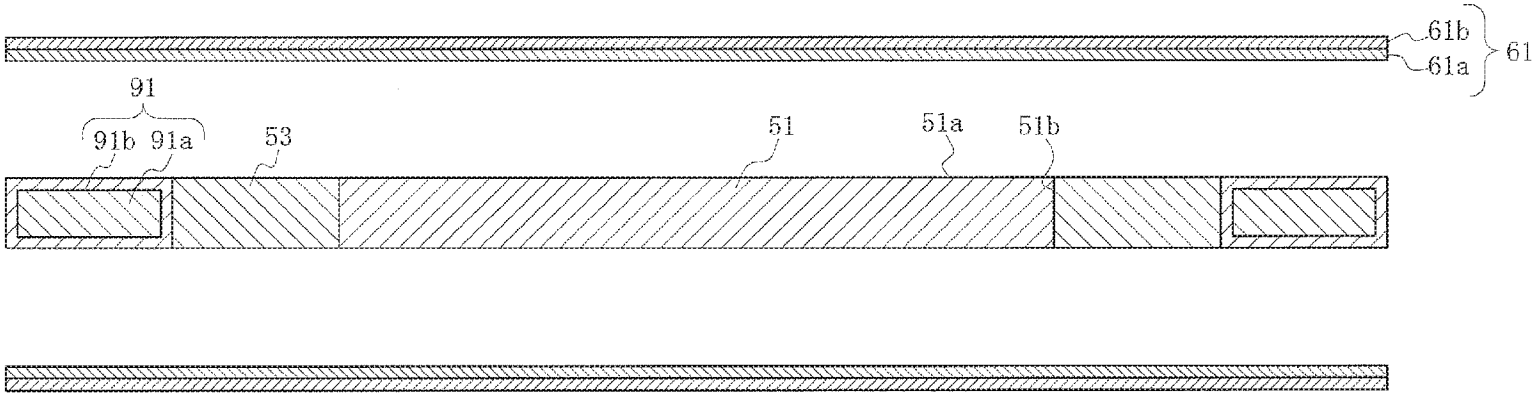
FIG. 4 is a cross-sectional view used to explain the lamination steps in the method for manufacturing the waveguide in the embodiment of the present disclosure.
Figure 5:
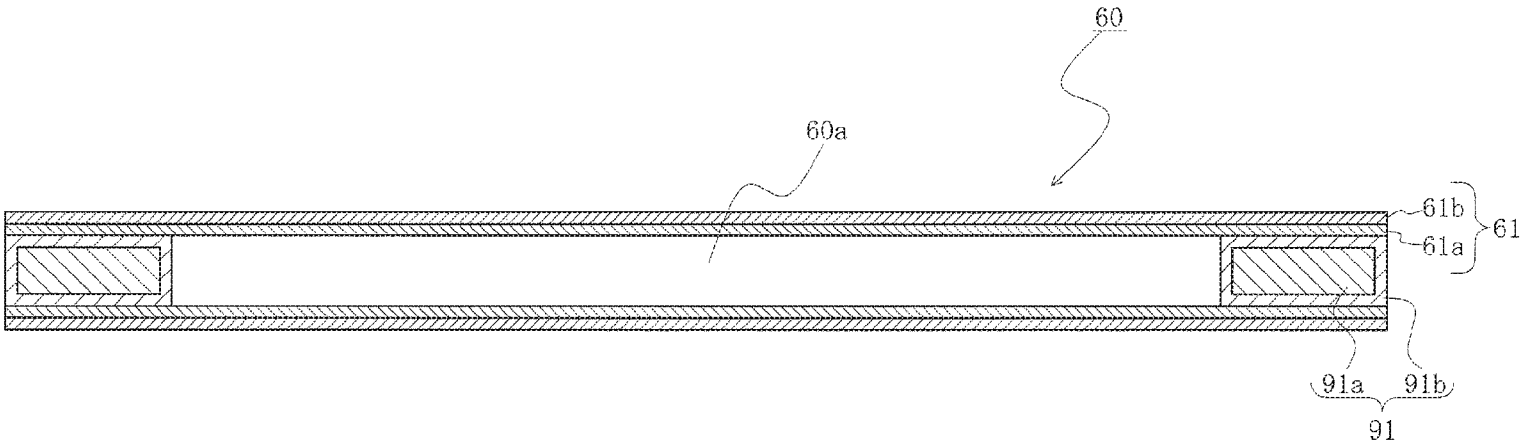
FIG. 5 is a cross-sectional view of the frame portion of the embodiment of the present disclosure.
Figure 6:
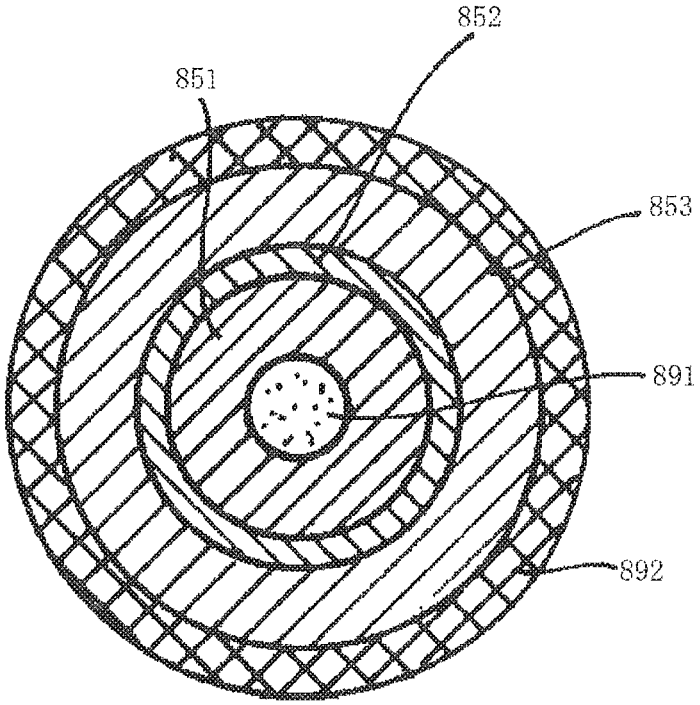
FIG. 6 Prior Art
FIG. 6 is a cross-sectional view of a waveguide of the prior art.

FIG. 4 is a cross-sectional view used to explain the lamination steps in the method for manufacturing the waveguide in the embodiment of the present disclosure, and FIG. 5 is a cross-sectional view of the frame portion of the embodiment of the present disclosure.

As mentioned above, the dielectric 51 (FIG. 4) is a slender rod-shaped, wire-shaped, or band-shaped elongated member made of a dielectric material. It has a rectangular cross-sectional profile with a pair of long sides 51*a* opposing each other (as depicted in FIG. 4) and a pair of short sides 51*b* opposing each other.

When the dielectric 51, the adjustment members 53, and the power supplying lines have been disposed in a row in the longitudinal direction of the cross-section of the dielectric 51, the pair of external conductor members 61 are laminated on both sides in the direction of arrangement of the dielectric 51, the adjustment members 53, and the power supplying members 91 as shown in FIG. 4. More specifically, a surface of the conductive film portion 61*a* of each external conductor member 61, which is the surface that is not covered by the covering portion 61*b*, is brought into contact with the side surfaces of the dielectric 51, the adjustment members 53, and the power supplying members 91 on both sides in the thickness direction of the waveguide 50, and the dielectric 51, the adjustment members 53, and the power supplying members 91 are interposed on both sides in the thickness direction of the waveguide 50 by the pair of external conductor members 61.

Each power supplying member 91 is composed of a core metal portion 91*a* made of a conductive material with good conductivity such as a metal, and a covering portion 91*b* covering the core metal portion 91*a* made of a dielectric material with good adhesiveness and flexibility. The cross-sectional profile of these members is rectangular. The dimension of each power supplying member 91 in the thickness direction of the waveguide 50 is substantially the same as that of the dielectric 51 and the adjustment members 53. It is substantially the same as the dimension of the short sides 51*b*. Each power supplying member 91 is disposed to the outside of the pair of adjustment members 53 relative to the width direction of the waveguide 50. Here, the inside surfaces of the power supplying members 91 in the width direction of the waveguide 50 make contact with outer side surfaces of the adjustment members 53 in the width direction of the waveguide 50.

The external conductor members 61 are pressed towards the center of the waveguide 50 in the thickness direction while heating the components using a heating device such as a preheater to bond the covering portions 91*b* of the power supplying members 91 made of an adhesive material to the surface of the conductive film portions 61*a* of the external conductor members 61 that are not covered by the covering portions 61*b*. In this way, the outside surfaces of the pair of power supplying members 91 in the thickness direction of the waveguide 50 are brought into close contact with the inside surfaces of the pair of external conductor members 61 in the thickness direction of the waveguide 50 to obtain an angular tube-shaped frame portion 60 as shown in FIG. 5. This frame portion 60 functions as an integrated electromagnetic shield surrounding a central space 60*a* (as depicted in FIG. 5). The dielectric 51 and the adjustment members 53 are accommodated inside the space 60*a* without being bonded to the peripheral surfaces of the space 60*a*.

In this way, the waveguide 50 shown in FIG. 1 through FIG. 3 can be obtained. A waveguide 50 can be continuously manufactured by continuously transporting and supplying side-by-side an elongated dielectric 51, adjustment members 53, and power supplying members 91, and by continuously supplying and laminating a pair of external conductor members 61 on these components.

The elongated waveguide 50 obtained in this manner can be wound on a roll (not shown) and stored. It may also be cut to predetermined lengths and stored. When the waveguide 50 is cut, the power supplying members 91 are cut from the dielectric 51 and the adjustment members 53 to a predetermined length such as several millimeters to expose only the end surfaces of the power supplying members 91 on the cut surface. The end surfaces of the dielectric 51 and the adjustment members 53 are not exposed. In other words, the end surfaces of the dielectric 51 and the adjustment members 53 can be offset. The cut surface can then be used as the end surface of the waveguide 50 to be connected to another waveguide or connector. Electromagnetic waves can be transmitted between the end surface of the dielectric 51 and the end surface of the dielectric in the opposing waveguide or connector even when there is space for a short distance.

In the present embodiment, the waveguide 50 comprises: a solid dielectric 51 having a rectangular cross-section, a pair of power supplying members 91 disposed on the outside in the longitudinal direction of the cross-section of the dielectric 51, and an external conductor surrounding the dielectric 51; the outer surface of the dielectric 51 being slidably in close contact with the inner surface of the external conductor.

Because the adhesiveness of the dielectric 51 to the external conductor is good, transmission loss can be stabilized and reduced, and power can be transmitted. Also, the waveguide 50 is easy to manufacture, the structure of the waveguide 50 is simplified, and costs can be reduced. A highly reliable waveguide 50 can also be provided.

Here, the external conductor includes a pair of planar external conductor members 61 disposed on the outside in the short-axis direction of the cross-section of the dielectric 51. As a result, a high-quality external conductor can be inexpensively and stably provided.

Also, the dielectric 51 and the power supplying members 91 are disposed in a row in the longitudinal direction of the cross-section of the dielectric 51, and the external conductor members 61 are laminated on both sides in the direction of arrangement of the dielectric 51 and the power supplying members 91. The result is a waveguide 50 with a flat cross-sectional profile and excellent flexibility that is also able to transmit power.

In addition, the external conductor members 61 are bonded to both surfaces of the power supplying members 91. This simplifies the manufacturing process, reduces manufacturing costs, and results in an inexpensive waveguide 50.

Furthermore, each external conductor includes an adjustment member 53 disposed between the dielectric 51 and the power supplying member 91. As a result, the dimensions of the cross-section of the dielectric 51 can be adjusted in the longitudinal direction.

The present disclosure is not limited to the embodiment described above. Many variations are possible based on the spirit of the present disclosure which do not depart from the scope of the present disclosure.

The present disclosure can be applied to waveguides.

What is claimed is:

1. A waveguide comprising:

a solid dielectric having first and second opposite ends and first, second, third and fourth surfaces, wherein each surface extends in a longitudinal direction from the first end to the second end, the first, second, third and fourth surfaces defining a rectangular cross-section of the solid dielectric, the first and third surfaces being positioned opposite one another, the second and fourth surfaces being positioned opposite one another;

first and second power supplying lines, the first power supplying line extending in the longitudinal direction along the first surface of the solid dielectric, the second power supplying line extending in the longitudinal direction along the third surface of the solid dielectric; and first and second external conductors, the first external conductor extending in the longitudinal direction along the second surface of the solid dielectric, the second external conductor extending in the longitudinal direction along the fourth surface of the solid dielectric, whereby the first, second, third and fourth surfaces of the solid dielectric are surrounded by the first and second power supplying lines and the first and second external conductors respectively, wherein the second and fourth surfaces of the solid dielectric are slidably in close contact with the first and second external conductors, respectively.

2. The waveguide as defined in claim 1, wherein the first and second external conductors are each comprised of a film-like or foil-like conductive film portion and a covering portion which covers the conductive film portion.

3. The waveguide as defined in claim 2, wherein the conductive film portion is made of a conductive material.

4. The waveguide as defined in claim 1, wherein the first and second power supplying members are each bonded to each of the first and second external conductors.

5. The waveguide as defined in claim 4, further comprising first and second adjustment members which each extend in the longitudinal direction, the first adjustment member being positioned between the first surface of the solid dielectric, the first power supplying member and the first and second external conductors, the second adjustment member being positioned between the third surface of the solid dielectric, the second power supplying member and the first and second external conductors.

6. The waveguide as defined in claim 4, wherein the first and second power supplying members are each comprised of a core metal portion and a covering portion which covers the core metal portion, and wherein the first and second external conductors are each comprised of a film-like or foil-like conductive film portion and a covering portion which covers the conductive film portion, wherein the conductive film portion of the first external conductor is bonded to the covering portion of each of the first and second power supplying members, wherein the conductive film portion of the second external conductor is bonded to the covering portion of each of the first and second power supplying members, wherein the second and fourth surfaces of the solid dielectric are slidably in close contact with the conductive film portion of each of the first and second external conductors.

7. The waveguide as defined in claim 6, further comprising first and second adjustment members which each extend in the longitudinal direction, the first adjustment member being positioned between the first surface of the solid dielectric, the covering portion of the first power supplying member, the conductive film portion of the first external conductor, and the conductive film portion of the second external conductor, the second adjustment member being positioned between the third surface of the solid dielectric, the covering portion of the second power supplying member, the conductive film portion of the first external conductor, and the conductive film portion of the second external conductor.

8. The waveguide as defined in claim 1, wherein the solid dielectric is formed of a flexible dielectric material.

9. The waveguide as defined in claim 8, wherein the flexible dielectric material is a synthetic resin.

10. The waveguide as defined in claim 1, wherein the first and second power supplying members are each comprised of a core metal portion and a covering portion which covers the core metal portion.

11. The waveguide as defined in claim 10, wherein the core metal portion is made of a conductive material, and wherein the covering portion is made of a dielectric material.

12. The waveguide as defined in claim 1, wherein the solid dielectric is a solid rod-shaped or wire-shaped member that is continuously manufactured using an extrusion molding method.

* * * * *